US006345167B1

(12) United States Patent
Bean

(10) Patent No.: US 6,345,167 B1
(45) Date of Patent: Feb. 5, 2002

(54) SINGLE PASS DUPLEXING METHOD AND APPARATUS

(75) Inventor: Lloyd F. Bean, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/662,524

(22) Filed: Sep. 18, 2000

(51) Int. Cl.[7] ..... G03G 15/16; G03G 15/01
(52) U.S. Cl. ..... 399/302; 399/308
(58) Field of Search ..... 399/302, 309, 399/308, 312, 162; 430/126

(56) References Cited

U.S. PATENT DOCUMENTS 3,697,171 A * 10/1972 Sullivan ..... 430/126
3,775,102 A 11/1973 Punnett ..... 91/96
3,847,478 A * 11/1974 Young ..... 399/309
3,940,210 A 2/1976 Donohue ..... 355/355
4,427,285 A 1/1984 Stange ..... 355/3 FU
4,714,939 A * 12/1987 Ahern et al. ..... 399/309
5,070,369 A * 12/1991 Mahoney et al. ..... 399/301
5,138,389 A * 8/1992 Randall ..... 399/302
5,453,822 A * 9/1995 Anzai et al. ..... 399/307 X

* cited by examiner

*Primary Examiner*—Joan Pendegrass
(74) *Attorney, Agent, or Firm*—Tallan Nguti; Joseph Young

(57) ABSTRACT

A toner image reproduction machine and method for producing duplex toner images on a copy sheet during a single pass of the copy sheet. The toner image reproduction machine and method include a moveable image bearing member, imaging devices including a controller for forming a first desired toner image, and a second desired toner image on said moveable image bearing member, and a moveable intermediate transfer member forming a transfer nip with the image bearing member.

13 Claims, 4 Drawing Sheets

SINGLE PASS DUPLEXING METHOD AND APPARATUS

BACKGROUND OF THE INVENTION

This invention relates generally to toner image reproduction, and more particularly to a single pass duplexing method and apparatus for producing duplex toner images on a sheet in a single pass of the sheet in a toner image reproduction machine.

In a typical electrostatographic reproduction process machine, a photoconductive member is charged to a substantially uniform potential so as to sensitize the surface thereof. A portion of the charged photoconductive member is irradiated or exposed to a light image of an document being reproduced, thereby selectively dissipating charges thereon in the irradiated areas. This records an electrostatic latent image on the photoconductive member corresponding to the informational areas contained within the document. The latent electrostatic latent image recorded on the photoconductive member is then developed by bringing a developer material into contact therewith. Generally, the developer material comprises charged toner particles in a liquid, or adhering triboelectrically to dry charged carrier granules or other suitable toner supporting material. During such development, the charged toner particles are attracted to the latent image forming a toner image on the photoconductive member. The toner image is then transferred from the photoconductive member to a copy sheet, and then heated to permanently affix it to the copy sheet. The foregoing generally describes a typical monochrome, for example, black and white electrostatographic reproduction process machine.

Several methods representing variations from the monochrome or single color process are known for producing multicolor images. In general, to produce multicolor images, different color components of a composite color image are formed and then put together in registration to achieve the composite color image. One multicolor image production method, for example, involves a process utilizing a plurality of different color toner development units, a single photoreceptor, and a multiple image frames single pass approach in which the monochrome or single color process is repeated for three or four cycles. In each cycle a component latent image of a composite multicolor final color is formed, and a toner of a different color is used to develop the component latent image.

Each developed component image as such is then transferred to the copy sheet. The process is repeated, for example, for cyan, magenta, yellow and black toner particles, with each color toner component image being sequentially transferred to the copy sheet in superimposed registration with the toner image previously transferred thereto. In this way, several toner component images, as are in the composite image, are transferred sequentially to the copy sheet, and can then be heated and permanently fused to the sheet.

A second method for producing color copies involves what is referred to as the tandem method which utilizes a plurality of independent imaging units for forming and developing latent component images, and a moving image receiving member such as an intermediate transfer roller or belt. In this method, the toned or developed component images from the imaging units are transferred in superimposed registration with one another to the intermediate roller or belt, thereby forming the multicolor composite image on the belt or roller. The composite image then can be transferred in one step to a sheet of copy paper for subsequent fusing.

A third method for producing color copies involves a single frame, single pass Recharge, Expose, and Develop (REaD) process. The REaD process uses a single photoreceptor, a single image frame thereon, and four imaging units each including imagewise exposure means and a development station containing a different color toner of cyan, magenta, yellow or black.

A composite subtractive multicolor image can thus be produced in a single pass, and on the single frame by charging, exposing and developing, then recharging, exposing and developing again utilizing this Recharge, Expose, and Develop (REaD) process architecture. In this process, digital version of the original or document is created pixel by pixel at a computer workstation or by a scanner. When created by scanning, light reflected from the original or document is first converted into an electrical signal by a raster input scanner (RIS), subjected to image processing, then reconverted into a light, pixel by pixel, by a raster output scanner (ROS).

In either case, the ROS exposes the charged photoconductive surface to record a latent image thereon corresponding to the subtractive color of one of the colors of the appropriately colored toner particles at a first development station. The photoconductive surface with the developed image thereon is recharged and re-exposed to record a latent image thereon corresponding to the subtractive primary of another color of the original. This latent image is developed with appropriately colored toner. This process (REaD) is repeated until all the different color toner layers are deposited in superimposed registration with one another on the photoconductive surface. The multi-layered toner image is transferred from the photoconductive surface to a sheet of copy paper. Thereafter, the toner image is fused to the sheet of copy paper to form a color copy of the original. The REaD process can also be performed as a multiple pass process.

In each of the different types of toner image reproduction machines described above, it is often necessary to produce duplex images or images on both sides of a copy sheet. Conventionally, in order to accomplish such production of duplex copies, or simply such "duplexing", the copy sheet somehow has to be inverted either on the fly, or with the use of a duplex intermediate holding tray.

SUMMARY OF THE INVENTION

In accordance with the present invention, there is

Other features of the present invention will become apparent from the following drawings and description.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment of one type of an electrostatographic color reproduction machine, it will be understood that it is not intended to limit the invention to that embodiment. On the contrary, it is intended to cover all alternatives, modifications, and equivalents as may be included within the spirit and scope of multicolor image registration of the invention as defined by the specification and appended claims.

Inasmuch as the art of electrostatographic reproduction is well known, the various processing stations employed in the exemplary FIG. 1 toner image reproduction machine 200 will be shown hereinafter only schematically, and their operation described only briefly with reference thereto.

The single pass duplexing method and apparatus of the present invention can be practiced in a monochrome (single color) reproduction machine and equally in multicolor reproduction machines. The exemplary reproduction machine 200 of FIG. 1 thus is capable of producing a single color (e.g. black and white background) image, or a multicolor image in a single pass.

Figure 1:
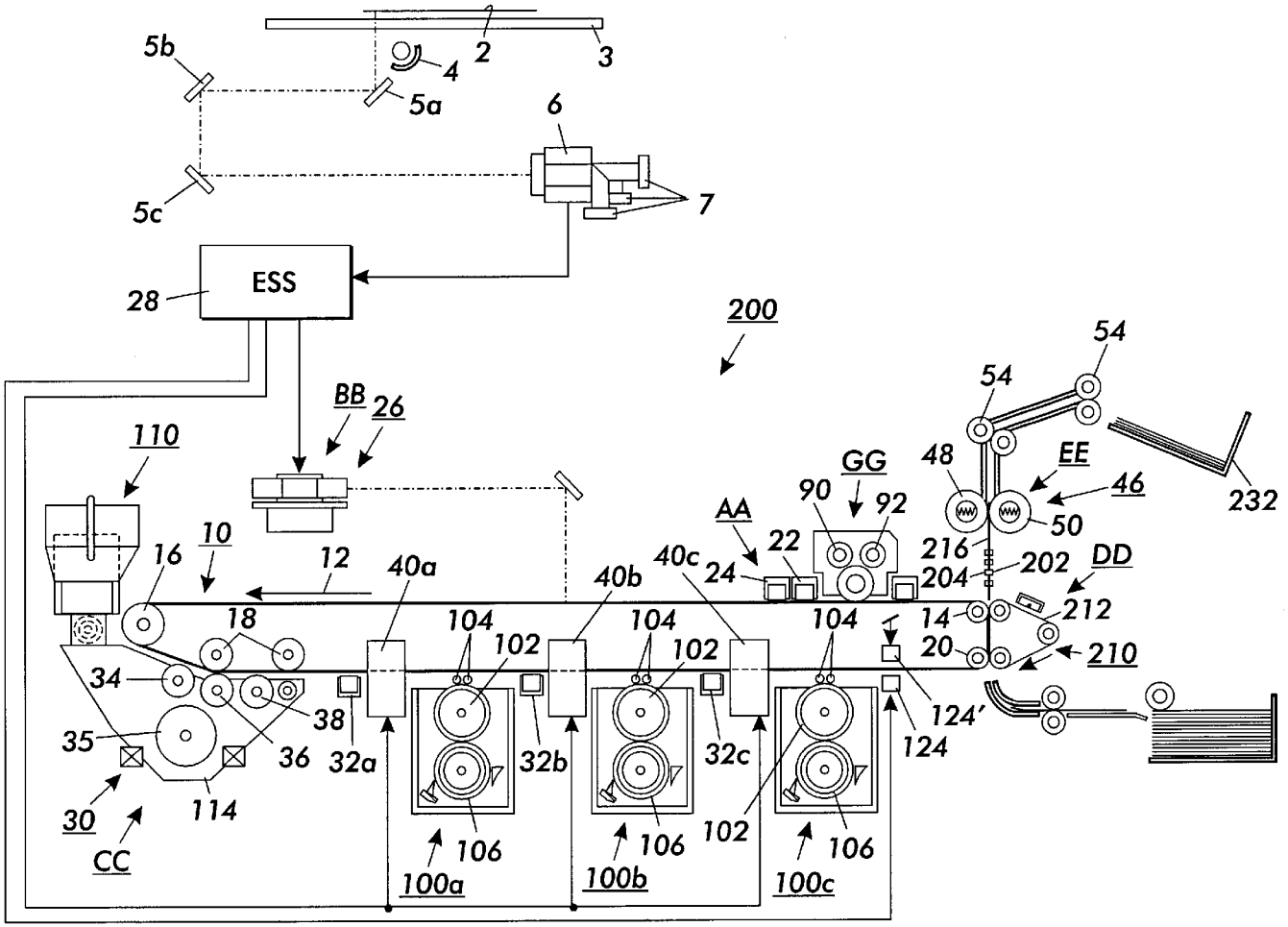
FIG. 1 is a schematic elevational view depicting an illustrative or exemplary electrostatographic toner image reproduction machine incorporating t single pass duplexing apparatus of the present invention.

Referring now to FIG. 1 a black-first single pass REaD (Recharge, Expose and Develop) electrostatographic toner image reproduction machine 200 is illustrated for producing copies of monochrome or multicolor images in proper registration. Note that such a machine can also be a multiple pass machine. The color copy process of such a machine typically involves a computer generated digital color image which may be inputted into an image processor unit (not shown), or alternately a digital image can be created by scanning from a color document 2 placed on the surface of a transparent platen 3. A scanning assembly having a halogen or tungsten lamp 4 is used as a light source to illuminate the color document 2. The light reflected from the color document 2 is reflected by mirrors 5*a*, 5*b* and 5*c*, through lenses (not shown) and a dichroic prism 6 to three charged-coupled devices (CCDs) 7 where the information is read.

The reflected light is separated into the three primary colors by the dichroic prism 6 and the CCDs 7. Each CCD 7 outputs an analog voltage which is proportional to the strength of the incident light. The analog image signal from each CCD 7 is converted into an 8-bit digital image signal for each pixel (picture element) by an analog/digital converter. The digital image signal enters an image processor unit. The output voltage from each pixel of the CCD 7 is stored as a digital signal in the image processing unit. The digital signals which represent the blue, green, and red density signals is converted in the image processing unit into four bitmaps: yellow (Y), cyan (C), magenta (M), and black (K). The bitmap represents the exposure value for each pixel, the color components as well as the color separation.

The electrostatographic toner image reproduction machine of the present invention employs a photoreceptor or photoconductive belt 10, which for example is made from a photoconductive material coated on a ground layer, which, in turn, is coated on anti-curl backing layer. Belt 10 has a photoconductive surface 11 and at least a single frame size portion to its length. Preferably belt 10 has a plurality of such portions or frames, and moves in the direction of arrow 12 to advance successive such portions or frames sequentially through various processing stations disposed about the path of movement thereof. Belt 10 is entrained about stripping rollers 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under a desired tension. Drive roller 20 is rotated by a motor (not shown) coupled thereto by suitable means, such as a belt means. As roller 20 rotates, it advances belt 10 in the direction of arrow 12.

Initially, a first portion or frame of the photoconductive surface 11 passes through charging station M, followed of course by a second such portion. At charging station AA, two corona generating devices, indicated generally by the reference numerals 22 and 24, sequentially charge each of the first and second portions or frames of the photoconductive surface 11 to a relatively high and substantially uniform potential. Corona generating device 22 places all the required charge on each portion or frame, corona generating device 24 acts as a leveling device, and fills in any areas missed by corona generating device 22.

Next, the charged portions or frames of the photoconductive are sequentially advanced through at least a first imaging station BB. At imaging station BB, the uniformly charged portions or frames of the photoconductive surface are sequentially exposed by a latent imager, such as a laser based output scanning device 26, which causes each of charged portions or frames to be discharged in accordance with a desired output from the scanning device, which for example is a laser raster output scanner (ROS) device. The ROS device 26 thus performs a function of creating on each portion or frame a desired latent output image.

Under the control of an electronic control subsystem (ESS) 28, the ROS device 26 creates the desired latent image in a series of horizontal scan lines with each line having a certain number of pixels per inch, as well as a desired orientation. The ROS device 26 may include a laser with rotating polygon mirror blocks and a suitable modulator or, in lieu thereof, a light emitting diode array (LED) as a write bar.

The electronic control subsystem (ESS) 28 is the primary control electronics which prepare and manage the image data flow between the imaging processing unit and the ROS device 26. ESS 28 as such may also include a display, user interface, and electronic storage, i.e. memory, functions. The ESS is actually a self-contained, dedicated mini computer, and in accordance with the present invention can control the ROS device 26 to form a desired latent image unconventionally on a portion or frame of the photoconductive surface 11 so that such image has a right-reading or positive-sense as viewed by a reader (FIG. ). Similarly, it can form a desired latent image conventionally on a portion or frame of the photoconductive surface 11 so that such has a wrong-reading or mirror-sense (FIG.).

As will be described more fully below, in accordance with the present invention, the first desired toner image (202) in the single pass duplexing operation, is formed (on the first portion or frame of the surface 11) unconventionally as a positive-sense image, starting with the ROS device 26. Thus the first desired latent image formed by the ROS device 26 on the leading or first portion or frame of the surface 11 is unconventionally a positive-sense image. As such, this first desired latent image after development, will be transferred onto the intermediate transfer member (212, see below) as a mirror-sense toner image, and then transferred back to a copy sheet as a right-reading, positive-sense image with proper reader viewing. However, as another aspect of the present invention, the second desired latent image on the following or second portion or frame will be formed conventionally as a wrong-reading or mirror-sense (FIG. ). As such, this second desired latent image after development, will be transferred directly onto a side of a copy sheet as a right-reading, positive-sense image with proper reader viewing.

It should be noted that in a non-duplexing operation of the toner reproduction machine 200, the latent monochrome or color separation images as well as the toner images therefrom would each be formed conventionally on the first and second frames of the surface 11 as mirror-sense or wrong-reading images before being advanced to the transfer station DD where they will each be transferred directly onto a copy sheet.

Still referring to FIG. 1, the first desired latent image (positive-sense), formed thus on the first charged portion or frame of the photoconductive surface 11 by ROS device 26, corresponds to a first desired black image, or to the black color portion of a first desired multicolor image to be printed. The second desired latent image (mirror-sense), formed thus on the second charged portion or frame of the photoconductive surface 11 by ROS device 26, also corresponds to a second desired black image, or to the black color portion of a second desired multicolor image to be printed. The belt 10, with the first and second desired black images, or the black color portions of the first and second desired multicolor images to be printed, is then advanced to a first development station CC.

At development station CC, a magnetic brush development system for example, indicated generally by the reference numeral 30 advances developer material consisting of carrier granules and charged black toner particles into contact with the electrostatic latent images on the belt 10. The development system typically comprises a plurality of three magnetic brush developer rollers, indicated generally by the reference numerals 34, 36 and 38. A paddle wheel 35 picks up developer material from developer sump 114 and delivers it to the developer rollers.

When developer material reaches rolls 34 and 36, it is magnetically split between the rolls with half of the developer material being delivered to each roll. Photoconductive belt 10 is partially wrapped about rolls 34 and 36 to form extended development nips. A magnetic roller, positioned after developer roll 38, in the direction of arrow 12, is a carrier granules removal device adapted to remove any carrier granules adhering to belt 10. Thus, rolls 34, 36, and 38 advance developer material into contact with the electrostatic latent images. The latent images then attract charged black toner particles from the carrier granules of the developer material to form developed black toner images on the first and second portions or frames of the photoconductive surface 11 as each such portion or frame passes the development system 30.

Figure 2:
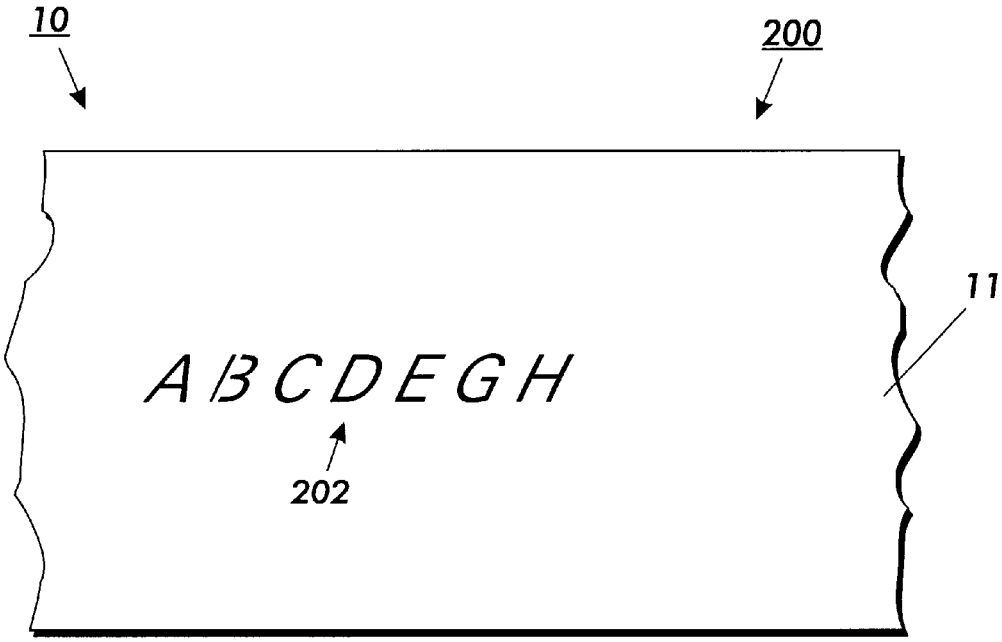
FIG. 2 is a schematic illustration of the first portion or frame of the image bearing member of the machine of FIG. 1 showing a positive-sense first desired image thereon in accordance with the present invention.
Figure 3:
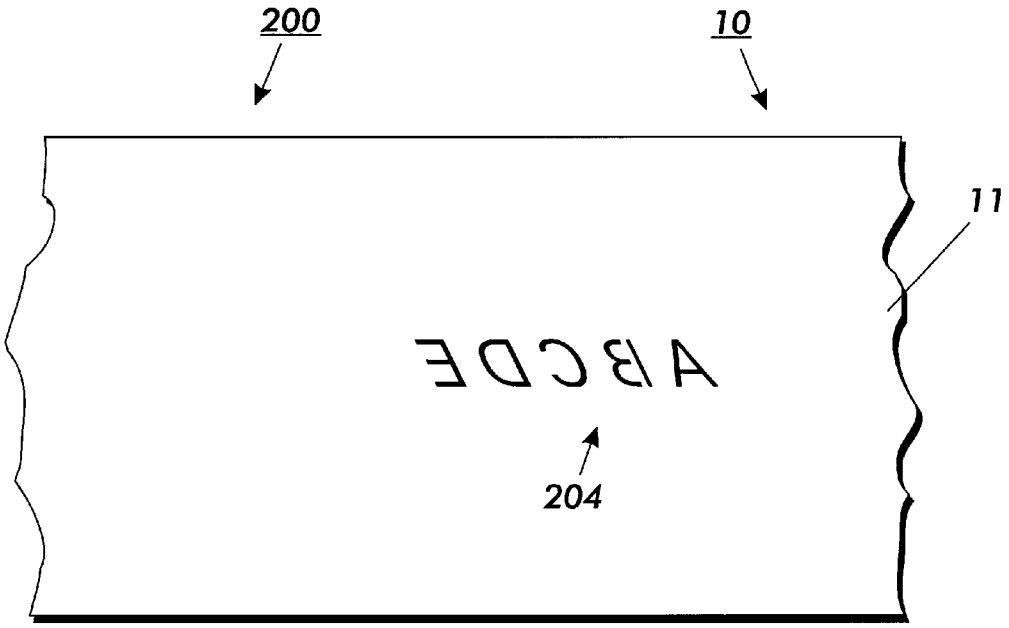
FIG. 3 is a schematic illustration of the second portion or frame of the image bearing member of the machine of FIG. 1 showing a mirror-sense second desired mage thereon in accordance with the present invention.

If the black images being reproduced are each a monochrome, black only image, subsequent charging, re-exposure and further development with other toners as are possible with the machine 200, will be unnecessary, and the black toner images will be the first and second desired toner images (202, 204 respectively, FIGS. 2 and 3). As such, these images will proceed directly to the downstream transfer station DD where they will be handled in accordance with the present invention (to be described in detail below), as part of a duplex set of images on a copy sheet.

However, when the images being reproduced are to be multicolor images, then as illustrated, after the development station CC, each of the black toner developed images continues is sequentially advanced in the direction of arrow 12 to a recharging station including a corona generator 32*a*. Corona generator 32*a* recharges each of the already imaged first and second portions or frames of the photoconductive surface 11, which is then moved to a second latent imaging or exposure station 40*a*. The exposure station 40*a* for example may includes an LED image array bar, an LCD shutter image bar, or another ROS device 26.

The imaging station 40*a* is controlled by the ESS 28, and is used as such to superimpose a subsequent unconventional positive-sense color separation latent image on the first frame, and to superimpose a subsequent conventional mirror-sense color separation latent image on the second frame. As is well known, it does so by selectively discharging in registration each recharged portion of the photoconductive surface 11. Similarly, following prior similar recharging by corona devices 32*b* and 32*c*, subsequent color separation latent images having the appropriate sense (positive-sense in the first frame and mirror-sense in the following or second frame) in accordance with the present invention, are subsequently superimposed at imaging stations 40*b* and 40*c*.

In each case, the subsequent color separation images are then developed by an appropriate color toner developer unit, for example the second development unit 100*a*. Thus, still referring to FIG. 1, developer unit 100*a* which is representative of the operation of development units 100*b* and 100*c*, for example, includes a donor roll 102, electrode wires 104 and a magnetic roll 106. The donor roll 102 can be rotated either in the (with) or (against) direction relative to the motion of belt 10. Electrode wires 104 are located in the development zone defined as the space between photoconductive belt 10 and donor roll 102. The distance between wires 104 and donor roll 102 is approximately the thickness of the toner layer on donor roll 102. A voltage source electrically biases the electrode wires with both a DC potential and an AC potential.

In operation, magnetic roll 106 advances developer material comprising carrier granules and toner particles into a loading zone adjacent donor roll 102. The electrical bias between donor roll 102 and magnetic roll 106 causes the toner particles to be attracted from the carrier granules to donor roll 102. Donor roll 102 advances the toner particles to the development zone. The electrical bias on electrode wires 104 detaches the toner particles on donor roll 102 and forms a toner powder cloud in the development zone. The latent images on the first and second frames attract the detached toner particles to form a toner image thereof as each latent image passes by the donor roll 102. The toner particles in developer unit 100*a* are, for example, of the color magenta.

Following development by the development unit 100*a*, the surface 11 is again recharged by the charging unit 32*b* and then advanced to the next imaging station having imager 40*b*. The imager 40*b* as above, then superimposes another latent color separation image of an appropriate sense by selectively discharging portions of the frames of the recharged photoconductive surface 11 being imaged. As described above, if each of such subsequent latent color separation images being superimposed is part of a single pass duplexing operation in accordance with the present invention, then the first desired image on the first frame will be formed unconventionally as a positive-sense image and the second desired image on the second frame will be formed conventionally as a mirror-sense image. An appropriate developer unit 100*b* then develops the formed latent color separation images for example with yellow toner.

The portions or frames of surface 11 being imaged are each thereafter again sequentially recharged by charging unit 32*c* and then reexposed by imager 40*c* in an appropriate sense in accordance with the present invention. Imager 40*c* similarly superimposes a subsequent latent color separation image on the recharged and imaged first and second frames by selectively discharging appropriate portions thereof. An appropriate developer unit 100*c* then develops these subsequent images for example with cyan toner.

Figure 4:
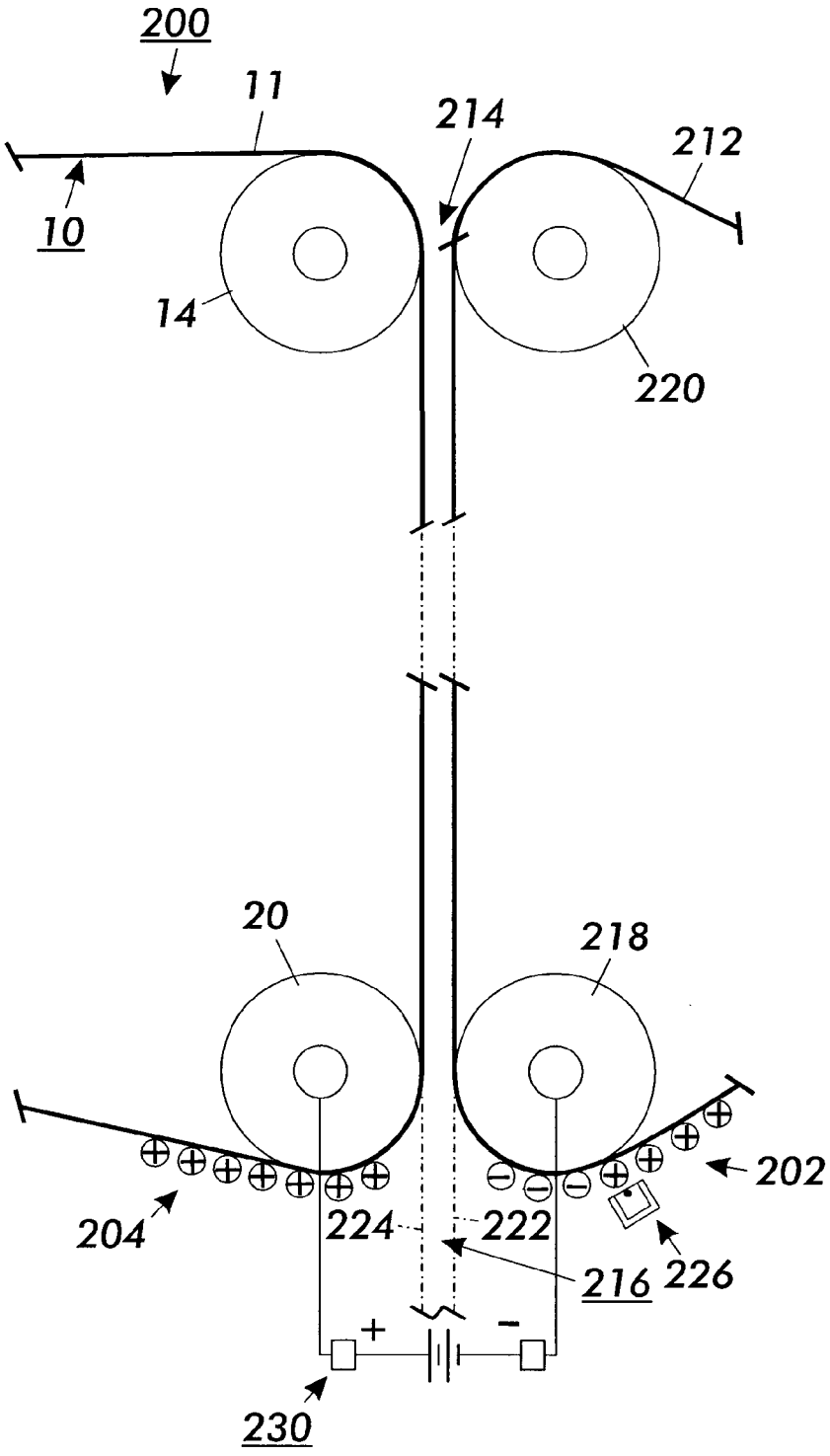
FIG. 4 is an enlarged and detailed schematic of the transfer station of the machine of FIG. 1.
Figure 5:
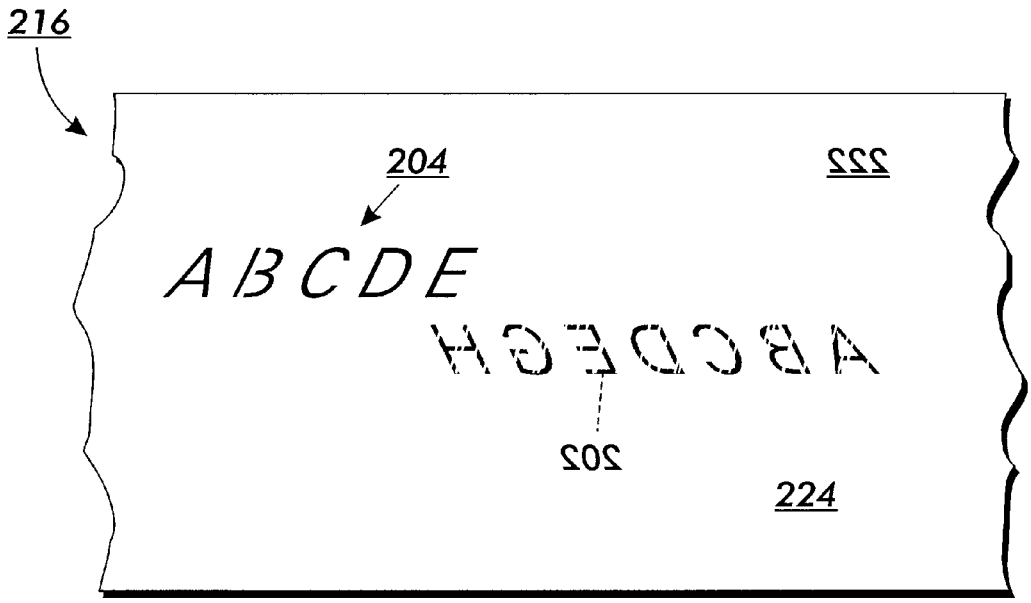
FIG. 5 is an illustration of a duplexed copy sheet produced according to the present invention.

Referring now to FIGS. 1–5, and particularly FIGS. 2–4 the resultant images are thus a positive-sense or right-reading first desired multicolor toner image 202 on the first frame (FIGS. 2), and a mirror-sense or wrong-reading second desired multi-color toner image 204 on the second frame (FIGS. 3 and 4). The resultant first and second desired multicolor toner images 202, 204 are then sequentially advanced to transfer station DD, where they will be handled in accordance with the single pass duplexing method of the present invention as the first and second images of a duplex set of images on a copy sheet 216.

Still referring to FIGS. 1–5, the single pass duplexing apparatus and method of the present invention are illustrated. As shown, for such apparatus and method, the transfer station DD of the machine 200 includes a transfer means or assembly 210. The transfer means or assembly 210 is suitable for handling (as part of a duplex set of images on a copy sheet 216) the positive-sense, first desired toner image 202 (which as above can be a monochrome black only image or a multicolor toner image), as well as the mirror-sense, second desired toner image 204 (which as above can also be a monochrome black only image or a multicolor toner image).

As shown, the transfer assembly 210 includes an intermediate transfer member 212 shown in the form of a belt, that forms a toner image transfer nip 214 with the image bearing member 10. The intermediate transfer belt 212 as shown is trained about a plurality of rollers including a roller 218 that functions as a back up roller to the roller 20 of the image bearing member or belt 10, and another roller 220 that functions as a back up roller to the roller 14 of the image bearing member or belt 10. The rollers 218 and 220 are spaced apart so as to be aligned with the belt 10 back up rollers 14 and 20. The transfer nip 214 is thus a long nip with image transfer beginning between the pair of rollers 20 and 218, and final separation occurring at and leaving the rollers 14 and 220. The transfer assembly 210 as such is suitable for first transferring the positive-sense, first desired toner image 202 (monochrome or multicolor) from the moveable image bearing member or belt 10 onto the moveable intermediate transfer member 212.

Thus as shown, the image bearing member 10 comprises a belt, the intermediate transfer member 212 comprises a resistive transfer belt, and the transfer assembly 210 includes a first pair of backing rollers 20, 218 forming an entrance into the transfer nip 214, and a second pair of backing rollers 14, 220 forming an exit from the transfer nip 214 downstream of the pair of rollers 20, 218, relative to movement of the image bearing member 10.

In accordance with the present invention, the single pass duplexing method for producing duplex toner images in the toner image reproduction machine 200, includes the steps of first forming the first desired toner image 202 as above on a first frame of the moving image bearing member or belt 10; transferring the first desired toner image 202, at the transfer station DD, from the moving image bearing member onto the moving intermediate transfer member 212. The method also includes the steps of next similarly forming a second desired toner image 204 on the second frame of the moving image bearing member or belt 10; feeding a copy sheet 216 having a first side 222, and a second side 224, in timed registration into the transfer nip 214.

The method then includes the step of simultaneously transferring within the transfer nip 214 both the first desired toner image 202 from the moving intermediate transfer member 212 onto the first side 222 of the copy sheet 216, and the second desired toner image 204 from the image bearing member 10 onto the second side 224 of the copy sheet 216. In this manner, a duplex or two-sided imaged copy sheet is produced at the transfer station DD, during a single pass of the copy sheet 216 through the transfer station.

The mirror-sense, second desired toner image 204 on the moving image bearing member 10 is thus transferred as a positive-sense toner image directly onto the second side 224 of the copy sheet 216. At the same time, the positive-sense, first desired toner image 202 (which had already been transferred as a mirror-sense image in a first transfer step from the moving image bearing member 10 onto the intermediate transfer member 212 during a pass of the first frame of the surface 11 through the transfer nip 214), is now simultaneously transferred as a positive-sense toner image from the intermediate transfer member 212 directly onto the first side 222 of the copy sheet 216.

Referring in particular to FIG. 4, the transfer assembly 210 further includes a charging device 226, for recharging the first desired toner image 202 on the intermediate transfer member 212 so as to reverse a polarity of its charge from that of its pre-transfer charge (as present on the image bearing member 10). As shown, where the pre-transfer charge of toner images is positive on the image bearing member 10, the charging device effectively reverses that on the intermediate transfer member 212 to a negative charge.

The copy sheet 216, having two suitable image receiving sides, a first side 222 and a second side 224, is controllably fed in timed registration into the transfer nip arrangement for simultaneously contacting and receiving the first desired toner image 202 from the intermediate transfer member 212 onto its first side 222, and the second desired toner image 204 from the image bearing member 10 onto its second side 224. As shown in FIG. 4, a biasing scheme using a biasing device 230, appropriately and oppositely biases the first pair of backing rolls 20, 218 at the entrance into the transfer nip 214 so as to facilitate simultaneous transfer of the oppositely charged first and second desired toner images 202, 204 onto the copy sheet 216.

As illustrated, with the second desired toner image 204 still on the image bearing member 10 and possessing a pre-transfer charge, shown for example as positive, the biasing device 230 biases the backing roller 20 positively so as to force (repel) the positively charged toner image 204 from the image bearing member 10 towards the second side 224 of the sheet 216. Similarly, with the first desired toner image 202 already on the intermediate transfer member 212 and recharged to a post-transfer opposite charge, shown for example as negative, the biasing device 230 thus appropriately biases the backing roller 218 negatively so as to force (repel) the then negatively charged toner image 202 from the intermediate transfer member 212 towards the first side 222 of the sheet 216.

The next toner image is of course to be transferred to the intermediate transfer belt 212 at the exit from the transfer nip 214, and then recharged oppositely by the charging device 226 as above.

Referring again to FIG. 1, with the first and second desired toner images 202, 204 simultaneously transferred onto the first and second sides 222, 224 respectively of the copy sheet 216, the copy sheet 216 is then advanced to a fusing station EE. Fusing station EE for example includes a fuser assembly indicated generally by the reference numeral 46, which permanently affixes the transferred duplex toner powder images to the copy sheet 216. Preferably, fuser assembly 46 includes a pair of heated fuser rolls 48 and 50 in pressure contact with each other for simultaneously contacting, heating and fixing the first desired toner image 202 on the first side 222, and the second desired toner image 204 on the second side 224 of the copy sheet 216.

The heated fuser rolls 48, 50 are positioned for directly and immediately receiving the copy sheet 216 carrying a toner image on each side thereof, as the sheet exits the transfer nip 214. Each heated fuser roll 48, 50, is heated for example internally by a quartz lamp. Release agent, stored in a reservoir, may pumped to a metering roll, and transferred to the surface of each fuser roll 48, 50 for facilitating toner release therefrom. After fusing, the sheets are for example, fed through forwarding rollers 54 to an output area such as a tray 232.

With continued reference to FIG. 1, after the sheet is separated from photoconductive belt 10, some residual toner particles in the image frame remain adhering thereto and the developed registration marks. After transfer, photoconductive belt 10 passes beneath corona generating device 94 which charges the residual toner particles to the proper polarity. Thereafter, the pre-charged array lamp (not shown), located inside photoconductive belt 10 discharges the photoconductive belt in preparation for the next imaging cycle. Residual particles and registration marks are removed from the photoconductive surface at cleaning station GG.

Cleaning station GG includes an electrically biased cleaner brush 88 and two de-toning rolls 90 and 92, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper, debris and wrong sign toner particles. The toner particles on the reclaim roll are scrapped off and deposited in a reclaim auger (not shown), where it is transported out of the rear of the cleaning station GG.

While the single pass duplexing apparatus and method for producing duplex toner images have been shown and described in a single pass Recharge, Expose and Develop (REaD) color electrostatographic toner image reproduction machine, it should be understood that the invention could be used equally in a monochrome, tandem or other toner image reproduction machine.

In each such case, duplex (two-sided) copies of various widths and lengths can be made by the single pass duplexing apparatus and method of the present invention. The single pass duplexing apparatus and method of the present eliminate the need for an inverter and/or a duplexing storage tray. In addition, because the copy sheet makes a single pass through the fuser, the single pass duplexing apparatus and method of the present invention enable significant reductions in required fusing energy, as well as reductions in paper jams.

The intermediate transfer member or belt 212 and the image bearing member 10 can have any desired lengths that are suitable for single frame or dual frame duplexing. In single frame duplexing, the first desired toner image 202 is first formed as above on the single frame in a first pass of the image bearing member 10, transferred onto the intermediate transfer member 212. The frame is then cleaned as above and the second desired toner image 204 is then formed on the cleaned frame in a second pass of the image bearing member for subsequent simultaneous transfer with the first desired toner image 202, onto the copy sheet 216. In any case, the intermediate transfer member 212 and image bearing member 10 are preferably sprocketed at their outer edges in order to prevent the images thereon from being disturbed by contact with other machine parts.

It is, therefore, apparent that there has been provided in accordance with the present invention, a toner image reproduction machine and method for producing duplex toner images on a copy sheet during a single pass of the copy sheet. The toner image reproduction machine and method include a moveable image bearing member, imaging devices including a controller for forming a first desired toner image, and a second desired toner image on said moveable image bearing member, and a moveable intermediate transfer member forming a transfer nip with the image bearing member.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A toner image reproduction machine comprising:

(a) a moveable image bearing member including a belt;

(b) imaging means including a controller for forming a first desired toner image, and a second desired toner image, on said moveable image bearing member;

(c) a moveable intermediate transfer member including a belt, the transfer member forming a transfer nip arrangement with said image bearing member;

(d) a first pair of backing rollers forming an entrance to the transfer nip;

(e) a second pair of backing rollers forming an exit from the transfer nip downstream of said first pair of backing rollers relative to movement of said image bearing member; and (f) transfer means for first transferring, within said transfer nip arrangement, said first desired toner image from said moveable image bearing member onto said moveable intermediate transfer member, and for next simultaneously transferring both said first desired toner image from said intermediate transfer member onto a first side of a copy sheet then being fed through said transfer nip arrangement, and said second desired toner image from said image bearing member onto a second side of the copy sheet, thus producing a two-sided imaged copy sheet during a single pass of the copy sheet through the machine.

2. The toner image reproduction machine of claim 1, wherein said first desired toner image comprises a positive-sense toner image on said moveable image bearing member.

3. The toner image reproduction machine of claim 1, wherein said second desired toner image comprises a mirror-sense toner image on said moveable image bearing member.

4. The toner image reproduction machine of claim 1, wherein said first desired toner image comprises a monochrome toner image.

5. The toner image reproduction machine of claim 1, wherein said imaging means include a plurality of different color toner development devices and said first desired toner image comprises a multicolor toner image.

6. The toner image reproduction machine of claim 1, wherein said second desired toner image comprises a monochrome toner image.

7. The toner image reproduction machine of claim 1, wherein said imaging means include a plurality of different color toner development devices and said second desired toner image comprises a multicolor toner image.

8. The toner image reproduction machine of claim 1, including a charging device mounted adjacent said intermediate transfer member for recharging said first desired toner image on said intermediate transfer member.

9. The toner image reproduction machine of claim 1, wherein said image bearing member comprises a belt.

10. The toner image reproduction machine of claim 1, wherein said intermediate transfer member comprises a belt.

11. The toner image reproduction machine of claim 2, wherein said positive-sense first desired toner image on said moveable image bearing member is first transferred as a mirror-sense toner image onto said intermediate transfer member, and then as a positive-sense toner image onto the first side of the copy sheet.

12. The toner image reproduction machine of claim 3, wherein said mirror-sense second desired toner image on said moveable image bearing member is transferred only once as a positive-sense toner image from said image bearing member onto the second side of the copy sheet.

13. The toner image reproduction machine of claim 8, wherein said charging device recharges said first desired toner image and reverses charge on said first desired toner image from a pre-transfer charge thereof on the image bearing member to a charge opposite in polarity to said pre-transfer charge.

* * * * *